United States Patent [19]

Carter et al.

[11] Patent Number: 4,676,164

[45] Date of Patent: Jun. 30, 1987

[54] SPORTING AMMUNITION

[75] Inventors: George B. Carter, Lichfield; Alan P. Manby, Amington, both of England

[73] Assignee: IMI Kynoch Limited, Birmingham, England

[21] Appl. No.: 815,663

[22] Filed: Dec. 30, 1985

Related U.S. Application Data

[63] Continuation of Ser. No. 717,610, Apr. 1, 1985, abandoned, which is a continuation of Ser. No. 335,518, Dec. 29, 1981, abandoned.

[30] Foreign Application Priority Data

Jan. 8, 1981 [GB] United Kingdom ..... 8100398

[51] Int. Cl.[4] ..... F42C 19/10

[52] U.S. Cl. ..... 102/204; 102/470

[58] Field of Search ..... 102/204, 205, 469–471

[56] References Cited

U.S. PATENT DOCUMENTS

| | | | |
|---|---|---|---|
| 431,601 | 7/1890 | Lorenz | 102/470 |
| 2,068,516 | 1/1937 | Seavey | 102/204 |
| 2,188,760 | 1/1940 | Richardson | 102/204 |
| 2,423,837 | 7/1947 | Martin | 102/204 |
| 3,195,463 | 7/1965 | Foote et al. | 102/470 |
| 3,439,618 | 4/1969 | Gawlick et al. | 102/204 |
| 4,029,015 | 6/1977 | Lachaussee | 102/204 |

FOREIGN PATENT DOCUMENTS

| | | | |
|---|---|---|---|
| 2355272 | 1/1978 | France | 102/204 |
| 2442426 | 6/1980 | France | 102/204 |
| 6909 | of 1886 | United Kingdom | 102/204 |
| 23366 | 9/1905 | United Kingdom | 102/204 |

*Primary Examiner*—Harold J. Tudor

*Attorney, Agent, or Firm*—Cushman, Darby & Cushman

[57] ABSTRACT

A battery pocket for centerfire sporting ammunition, for example a shotgun cartridge, comprises a cap shell containing a quantity of impact-sensitive priming material, an anvil and a cap chamber having one or more flash holes therein, the or each flash hole being closed by a layer of material that is removable upon, and as a result of, impact-ignition of the priming material. The or each layer preferably comprises a particulate material, such as china clay, in a polymeric binder and the provision thereof renders the battery pockets less mass-explosible.

7 Claims, 3 Drawing Figures

SPORTING AMMUNITION

This is a continuation of Ser. No. 717,610, filed on Apr. 1, 1985, now abandoned, which is a continuation of Ser. No. 335,518, filed on Dec. 29, 1981 now abandoned.

BACKGROUND OF THE INVENTION

This invention relates to centrefire sporting ammunition, especially but not exclusively shotgun cartridges, and in particular relates to the priming device which, as is well known, forms a constituent part of such ammunition and which, upon impact by the striker pin of a gun, initiates rapid burning of propellant which also forms part of the ammunition.

Typically, a conventional priming device comprises a cup-shaped member (often, as hereinafter, referred to as a "cap shell") containing a quantity of highly impact-sensitive priming material, the cap shell being provided with an anvil between the tip of which and the base of the cap shell there is a nip containing some of the priming material. Usually, the cap shell and the anvil are separately formed and the assembly thereof is referred to as a "battery pocket". In one known design of battery pocket the anvil is integrally formed with a second cup-shaped member (commonly referred to as a "cap chamber") which, when assembled with the priming material-containing cap shell co-axially engages the cap shell with the anvil extending into the latter towards the base thereof. The base of the cap chamber is provided with one or more apertures, commonly referred to as "flash holes" which, upon firing, allow flame from the priming material to reach, and initiate burning of, the propellant charge. In commercial operations, battery pockets are of course produced on a large scale, typically millions per week in the larger factories, and they are stored and transported in bulk for eventual incorporation in rounds of ammunition.

One problem that arises with the bulk storage and handling of battery pockets is that of mass-explosibility, that is to say the tendency of at least a significant proportion of a batch of proximate battery pockets to explode in response to accidental ignition of one of the pockets in the batch. It will be appreciated that such a tendency creates a potential danger, particularly to personnel. Hitherto, the problem has been dealt with by applying to the upper surface of the priming material, after drying thereof, a protective membrane of, for example, a paper foil and varnish, followed by incorporation of the anvil, the anvil often penetrating the membrane and extending into the priming material. Whilst this solves the problem of mass explosibility, it involves processing, in bulk, caps containing dangerous, dry priming material. In addition, the application of a foil and varnish is a somewhat exacting process.

It has already been proposed that the anvil may be incorporated with the cap shell before the priming material is dried, the water and/or other liquid medium present in the priming material being able to issue through the flash holes during a subsequent drying operation. Because wet priming materials are usually relatively safe to manipulate, that proposal mitigates the danger associated with incorporating the anvil into a cap shell containing dry priming material but, because of further processing difficulties, the application of known types of membrane for dealing with the mass explosibility problem is impracticable.

It is an object of the present invention to provide a battery pocket having acceptable mass-explosibility properties, which is simpler to produce compared to conventional methods and which may, if desired, be made by a method that takes advantage of the above-mentioned proposal, ie drying of the priming material after assembly of the battery pocket.

SUMMARY OF THE INVENTION

According to one aspect of the present invention, there is provided a battery pocket for centrefire sporting ammunition, the battery pocket comprising a cap shell containing a quantity of impact-sensitive priming material, a cap chamber and an anvil, the cap chamber having one or more flash holes therein, the improvement comprising the or each flash hole being closed by a layer of a material that is removable upon, and as a result of, impact ignition of the priming material.

In a preferred embodiment, the or each said layer comprises a mass of particulate material that is permeable to, but which is stable towards, vapour, for example water vapour. In such an embodiment, the battery pocket may conveniently be made by a method including the above-mentioned proposal. Accordingly, in another aspect, the present invention provides a method of making a battery pocket, the method comprising the steps of:-

(a) taking a preformed cap shell, (b) providing a wet mass of priming material in the cap shell, (c) assembling with the cap shell a cap chamber and an anvil, the cap chamber having one or more flash holes, with the anvil extending into the mass of priming material, the or each flash hole being sealed by a layer of material that is vapour permeable and that is removable upon, and as a result of, ignition of the priming material when dry, and (d) drying the mass of priming material.

In preferred embodiments the anvil is integral with the cap chamber, as mentioned above, although the anvil could be a separately formed component.

In a battery pocket of the invention, the cap shell may be made of any material conventionally used in the art. Typically, for example, it will be a brass or steel pressing. Equally, the priming material may be one conventionally used in the art. It may consist solely of an impact-sensitive primary explosive compound, but usually it will consist of a composition comprising a primary explosive compound, for example lead styphnate, a sensitiser for the primary explosive compound, for example tetrazene, an oxidiser, for example barium nitrate, and a fuel, for example a mixture of calcium silicide and antimony sulphide. The priming material may be provided in the cap shell by conventional methods, but it is preferred to do this by a method described and claimed in our British Patent No. 1 569 874. More especially, the primary explosive compound, such as lead styphnate, is preferably formed in situ in the cap shell by the addition of water to a substantially dry, relatively insensitive mixture comprising components that react together in the presence of water forming the primary explosive compound, the dry mixture also containing other ingredients of the composition such as those mentioned above. Such a process is described and claimed in our above-mentioned British patent.

After provision of the wet priming material in the cap shell, the material may be dried followed by assembly of the cap shell/dry priming material with the cap chamber having its flash hole(s) sealed as aforesaid. Preferably, however, and in accordance with the method of the invention, the layer of material sealing the or each flash hole is vapour-permeable (water-vapour permeable in the usual case where the priming material is water-wet) and the cap chamber is assembled with the cap shell prior to drying of the priming material, the water vapour escaping through the water-permeable layer during drying. Drying may be effected in a heated compartment, as is conventional in the art.

A preferred water-permeable layer comprises an agglomeration of substantially dry, particulate material such as clay which agglomeration readily disintegrates upon ignition of the dry priming material effected by the blow of the striker pin of a gun.

Such a preferred layer may readily be provided in situ by dosing into the cap chamber a small quantity of a suspension of the particulate material in a liquid vehicle, for example water, an organic solvent or a mixture of water and an organic solvent, followed by drying. The liquid vehicle preferably contains an agent, for example a surfactant or thickening agent, to help maintain the particulate material in suspension. For example, in the case where the particulate material is China clay, "Cellofas" (a carboxymethylcellulose) has proved to be a suitable agent. In addition, the liquid vehicle preferably contains a binder for the particulate material, for example a dispersed or dissolved polymer, such as a styrene/acrylate polymer, "Texicryl" (an acrylic dispersion in water) or shellac. The composition of the suspension, and the amount thereof dosed into each cap chamber, may vary widely and conditions which lead to acceptable non-mass explosibility properties may be determined by simple experiment. By way of example, the following compositions may be mentioned:-

| | |
|---|---|
| Composition 1 | |
| Cellofas | 0.5 g |
| Water | 33.3 ml |
| China Clay (Grade E) | 16.7 g |
| Composition 2 | |
| Cellofas | 0.5 g |
| Texicryl 13-205 | 4.6 g solids/ |
| | 5.4 g water |
| China Clay (Grade E) | 45.0 g |
| Water | 325 ml |
| Composition 3 | |
| Cellofas | 18.6 g |
| Texicryl 13-205 | 17.1 g solids/ |
| | 20.1 g water |
| China Clay (Grade E) | 271.6 g |
| Water | 1209.0 g |

It has been found that, in relation to a cap chamber of a size typically used in a 12-bore shotgun cartridge battery pocket, the application of about 70 mg of any of the above dispersions, followed by drying, results in a product having acceptable ballistic and non-mass explosibility properties.

The dispersion may be dosed into the cap chamber in any of a number of ways. Conveniently, this may be done using a peg dosing machine which is commonly used in the art for dispensing varnish.

Whilst we have mentioned only clay as a suitable particulate material, other inert solid materials may be used. Examples are: pulverised fuel ash, slate powder, chalk, talc, silica powder and alumina powder, although clay, which is cheap and readily available is preferred.

The present invention also provides a unit of centrefire ammunition, for example a shotgun cartridge, comprising a battery pocket of the invention.

BRIEF DESCRIPTION OF THE DRAWINGS

The invention will now be described in more detail, by way of example only, with reference to the accompanying drawings, in which:-

DESCRIPTION OF THE PREFERRED EMBODIMENTS

Figure 1:
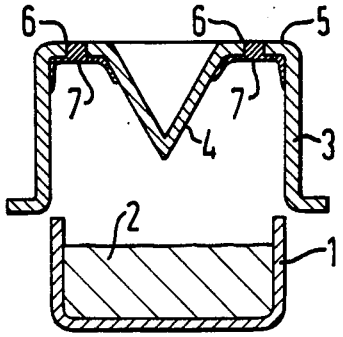
FIG. 1 is an exploded, sectional elevation of a battery pocket of the invention on an enlarged scale.
Figure 2:
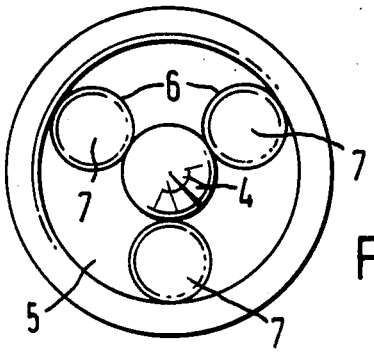
FIG. 2 is a plan view of the cap chamber shown in FIG. 1.

Referring to FIGS. 1 and 2, the battery pocket comprises a metallic, eg brass, cap shell 1 containing a predetermined quantity, typically 40 to 50 mg, of dry priming material 2 comprising lead styphnate, barium nitrate, lead dioxide, calcium silicide, antimony sulphide and tetrazene present in predetermined proportions. The lead styphnate was produced in situ in the cap by reaction between styphnic acid and lead monoxide in the presence of water, the styphnic acid and lead monoxide being present in a substantially dry mixture also containing the other ingredients mentioned above, a predetermined quantity of which mixture was dosed into the cap shell 1 prior to the addition of a small amount of water. Prior to drying of the material 2, a cap chamber 3 was assembled with the cap shell 1, followed by drying, to give the finished battery pocket shown in FIG. 3.

The cap chamber 3 comprises a cup-shaped member having an anvil 4 formed integrally with the base 5 thereof. The cap chamber 3 may, for example, be a metal pressing or die-casting. The base 5 of the cap chamber has three flash-holes 6 formed therein, each flash hole 6 being sealed by respective plugs 7 of water vapour-permeable, polymer-bonded particulate china clay. Each plug 7 was formed by dosing about 70 mg of one of the aforementioned suspensions into the cap chamber 3 followed by drying, prior to assembly of the cap chamber 3 with the cap shell 1. After assembly, the battery pocket was placed in an oven to effect drying of the wet priming material 2, the water vapour escaping through the plugs 7 during drying.

Figure 3:
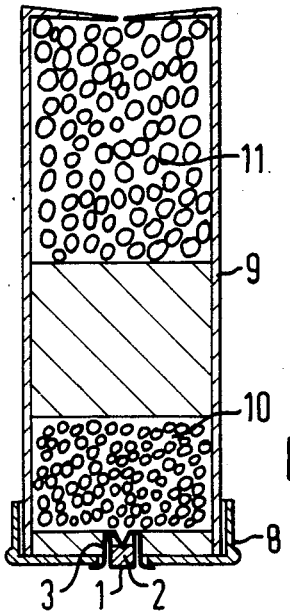
FIG. 3 is a sectional elevation of a 12-bore shotgun cartridge comprising an assembled battery pocket as shown in FIG. 1.

Referring to FIG. 3, as is known, the battery pocket is retained by the head 8 of a shotgun cartridge, which head 8 also retains a tubular body portion 9 which contains, inter alia, a charge of propellant 10 and a charge of lead shot 11. Upon firing, the striking pin of the shotgun strikes the base of the cap shell 1 whereupon the impact sensitive priming material 2 ignites and expels the plugs 7 from the flash holes 6 whereby flash may reach the propellant charge 10 and initiate burning thereof.

As already indicated, the battery pockets of the invention will usually be manufactured and further handled in bulk on a large scale. It has been found that the plugs 7 are highly obstructive to heat, sparks etc and that the battery pockets of the invention satisfactorily meet non-mass-explosibility requirements.

We claim:

1. A battery pocket for centrefire sporting ammunition, the battery pocket comprising a cap shell having an open end and containing a quantity of impact-sensitive priming material, a cap chamber having an anvil, an open end and an end wall opposite said open end and transverse to the axis of the chamber, there being a free space between the end wall and the priming material and the open end of the cap chamber having essentially the same cross-sectional area as the open end of the cap shell, said cap shell being fitted to said open end and the cap chamber having one or more flash holes formed in said end wall remote from the cap shell and occupying less than the transverse area of the end wall, the or each flash hole being filled with an inert material comprising a substantially dry particulate substance and a binder therefor, said material being removable upon, and as a result of, impact ignition of the priming material.

2. A battery pocket according to claim 1, wherein said particulate substance is selected from one or more of particulate clays, pulverized fuel ash, slate powder, chalk powder, talc powder, silica powder and alumina powder.

3. A battery pocket according to claim 1 wherein the binder is a synthetic polymer.

4. A battery pocket according to claim 3, wherein the polymer is an acrylic polymer.

5. A battery pocket according to claim 1, wherein said material filling the or each flash hole is vapor-permeable.

6. A battery pocket as in claim 5 wherein said material has been filled into the or each flash hole by dosing into the cap chamber a quantity of liquid containing the particulate substance and binder followed by evaporating said liquid.

7. Centrefire sporting ammunition comprising a head and a body and a battery pocket according to claim 1 fitted into a hole in said head.

* * * * *